US007717121B2

(12) United States Patent
Glatz

(10) Patent No.: US 7,717,121 B2
(45) Date of Patent: May 18, 2010

(54) FREE ARM PARASOL

(75) Inventor: Adolf Glatz, Frauenfeld (CH)

(73) Assignee: Glatz AG (CH)

( * ) Notice: Subject to any disclaimer, the term of this patent is extended or adjusted under 35 U.S.C. 154(b) by 155 days.

(21) Appl. No.: 11/990,481

(22) PCT Filed: Jul. 13, 2006

(86) PCT No.: PCT/CH2006/000368

§ 371 (c)(1),
(2), (4) Date: Feb. 14, 2008

(87) PCT Pub. No.: WO2007/022649

PCT Pub. Date: Mar. 1, 2007

(65) Prior Publication Data

US 2009/0095336 A1 Apr. 16, 2009

(30) Foreign Application Priority Data

Aug. 25, 2005 (CH) ..... 1392/05

(51) Int. Cl.
*A45B 23/00* (2006.01)
*A45B 17/00* (2006.01)

(52) U.S. Cl. ..... 135/21; 135/20.1; 135/20.3

(58) Field of Classification Search ..... 135/16, 135/20.1, 20.3, 21, 90; 116/173; 473/481, 473/484; 211/197
See application file for complete search history.

(56) References Cited

U.S. PATENT DOCUMENTS 2,905,187 A * 9/1959 Croce ..... 135/20.1
3,486,514 A * 12/1969 Prescott ..... 135/90
5,678,585 A * 10/1997 May ..... 135/20.1
5,735,302 A * 4/1998 Saliva ..... 135/20.1
6,014,980 A 1/2000 Glatz
6,152,156 A * 11/2000 Tung ..... 135/21
6,220,261 B1 * 4/2001 Glatz ..... 135/20.3
6,401,739 B1 * 6/2002 Bright et al. ..... 135/98

(Continued)

FOREIGN PATENT DOCUMENTS

DE 3229776 A1 * 4/1983

(Continued)

*Primary Examiner*—Winnie Yip
(74) *Attorney, Agent, or Firm*—George Pappas

(57) ABSTRACT

The invention relates to a free arm parasol which comprises a pole (2) whereon an extension arm (10) is guided such that it can be extended and detracted in the direction of the axis thereof, and can pivoted about the axis thereof. The extension arm (10) supports a parasol (12) on the end thereof and is rotationally mounted on the other end in a bearing (14). A carrier element (16), which is connected in an articulated manner to the pole (2), is connected to bearing. Also, a stopping device (24), which is used to stop the pivotable positioning of the extension arm (10), is provided on the bearing (14). Said stopping device comprises a steering bar (26) which is arranged in the extension of the extension arm (10), can be placed counter to the carrier element (16), can be locked to the carrier element (16) and can be pivoted about the axis of the extension arm (10) when in the unlocked state in order to improve the handling of the free arm parasol. Said arm is coupled in a detachable manner to the extension arm by means of a coupling device, according to a selected rotational angle in relation to the extension arm (10).

19 Claims, 10 Drawing Sheets

U.S. PATENT DOCUMENTS

| | | | | |
|---|---|---|---|---|
| 6,435,444 | B1 * | 8/2002 | Lin | 242/396.6 |
| 6,478,037 | B2 * | 11/2002 | Tung | 135/21 |
| 6,953,043 | B2 * | 10/2005 | Yu | 135/20.1 |
| 7,493,909 | B2 * | 2/2009 | Ma | 135/20.3 |
| 7,533,680 | B2 * | 5/2009 | Ma | 135/21 |
| 2004/0069333 | A1 | 4/2004 | Ma | |
| 2004/0261827 | A1 | 12/2004 | Chen | |
| 2006/0243311 | A1 | 11/2006 | Glatz | |

FOREIGN PATENT DOCUMENTS

| | | | |
|---|---|---|---|
| DE | 299 06 116 | U1 | 8/1999 |
| EP | 830 074 | B1 | 3/1998 |
| EP | 1550383 | A1 * | 7/2005 |
| WO | WO 2005/018369 | A | 3/2005 |

* cited by examiner

FREE ARM PARASOL

This application claims priority of PCT application PCT/CH2006/000368 having a priority date of Aug. 25, 2005, disclosure of which is incorporated herein by reference.

TECHNICAL FIELD

The invention relates to a cantilever parasol.

BACKGROUND OF THE INVENTION

A cantilever parasol of the type mentioned at the outset is known from EP 0 830 074 B. A split bearing ring of the bearing serves as a locking device, and on the one side the end of the arm is arranged to be rotatable thereon and on the other the carrier element is articulated thereto, this carrier element in turn being supported in articulated manner on the mast. For the purpose of locking, the bearing ring may be tensioned to the arm by means of a clamping screw. A handle that projects transversely to the arm serves to pivot the arm about its axis. It is disadvantageous that both the handle and the clamping screw are arranged relatively high up above the ground and so accessibility and handling is made more difficult, in particular for short people. Moreover, two hands are needed for operation, and pivoting the arm about its axis by means of the handle requires a relatively large force. Finally, the handle, which projects transversely to the arm, is bulky and makes it more difficult to pack the cantilever parasol up for transportation thereof.

WO2005/018369 discloses a cantilever parasol in which an arm is on the one hand, by one end and via a bearing, supported against a sliding sleeve that may slide along the mast and on the other hand, at its free end, carries a parasol. In the region between the bearing and the parasol the arm is supported at the upper part of the mast by means of a carrier element. By sliding the sliding sleeve downward along the mast, the arm may be folded in against the mast. The arm is mounted at the bearing and at the point of connection of the carrier element such that it may pivot about its axis. The arm is provided with a control rod that cooperates with a coupling device and makes it possible to lock the arm in various angular positions in relation to the bearing. The control rod may be locked on the mast. Although the cantilever parasol is easy to handle because the sliding sleeve and the control rod are located relatively low down, operation must be performed from the inside of the parasol, which is inconvenient and carries a risk of injury. In the folded-together condition, the cantilever parasol has a large overall height, which makes it much more difficult to transport the cantilever parasol both in the packed-up and unpacked condition, in particular for transportation in a car.

DE 299 06 116 U1 discloses a cantilever parasol having a mast, in which the parasol is suspended from an arm at the upper end. The arm is guided such that it may be slid axially in a pivotal guide on the mast. The arm may be axially slid in the pivotal guide by means of a handle. The arm is provided with a toothed rack that cooperates with a toothed pinion in the pivotal guide and serves to lock the arm in the extended position. This means it is not possible to pivot the arm about its axis in the pivotal guide. In order to pivot the parasol about the axis of the arm, the parasol is arranged on a part of the arm that is mounted such that it may pivot in the arm about the axis of the arm. A tensioning cone in this part of the arm serves to fix the arm part in relation to the arm and cooperates with a tensioning cone in the arm. The tensioning cones may be clamped in relation to one another by means of a threaded pin.

Because only the arm part is mounted such that it may pivot in the arm, the result is an unstable mounting of the arm part that is prone to malfunction and that moreover, because of its arrangement close to the crown, is only accessible with difficulty.

SUMMARY OF THE INVENTION

The object of the invention is to improve a cantilever parasol of the type mentioned at the outset.

Because the locking device has a control rod that is aligned such that it forms an extension to the arm, that may be angled in relation to the carrier element and that may on the one hand be latched to the carrier element and may on the other hand, in the unlatched condition, be pivoted about the axis of the arm and is detachably coupled to the arm by means of a coupling device at selectable angles of rotation in relation to the arm, the functions and settings that are required of the cantilever parasol may be performed simply and easily. The control rod puts the accessibility of the operating members at a smaller height above the ground, with the result that they are accessible even to relatively short people. Moreover, the operating members are located on the outside of the parasol, as a result of which operation is more convenient and more secure against accidents. Because of the lever arm formed by the control rod, it is also simpler and easier to pivot the arm about its axis. Because the control rod serves on the one hand to pivot the arm about its axis and on the other to lock the pivot position by latching the control rod to the carrier element, operation is made substantially simpler and can moreover be performed with one hand. However, the control rod also serves to extend and retract the arm along its axis, as a result of which this function of the cantilever parasol is made simpler and easier.

A particularly advantageous embodiment is where the bearing for the end of the arm is arranged in a housing on which on the one hand the carrier element is articulated and on the other hand a housing part that carries the control rod is mounted such that it may pivot about the axis of the arm, and in which the coupling device is arranged. As a result, the sensitive parts of the cantilever parasol are arranged in a housing, which on the one hand protects the sensitive parts from soiling and on the other also serves to provide functional reliability and protection from accidents. It is thus now virtually impossible for a person operating the parasol to be injured when handling it.

The further embodiment of the cantilever parasol is particularly advantageous, in accordance with which the coupling device has a first coupling part, which is arranged at the end of the arm, non-rotatably but slidably in the direction of the axis of the arm. The coupling part is pretensioned by means of a spring toward a second coupling part that is connected non-rotatably to the control rod. Associated with the first coupling part is a pressure piece that is actuable for the purpose of releasing the coupling device by means of a cam part on the control rod when the latter is pivoted out into an uncoupling region. Various regions are conceivable for the uncoupling region. It is advantageous if the uncoupling region of the control rod lies between the position in which the control rod is locked on the carrier element and the extended position, which runs in the axial direction of the arm. In this case, the control rod can be coupled and uncoupled to the arm at a good operating height. It is furthermore particularly advantageous if the control rod has, on either side of the cam part, support faces that cooperate with the pressure piece, in order to fix the control rod in the positions on either side of the cam part temporarily.

For the coupling device there is a vast range of possible embodiments, from a force-fitting construction of the coupling to a form-fitting one. The force-fitting construction makes a very fine adjustment possible but requires a relatively large amount of pretension of the coupling parts toward one another. For this reason, an embodiment of the coupling device is advantageous, in accordance with which the coupling device is of form-fitting construction and preferably takes the form of a toothed coupling.

To avoid malfunction of the cantilever parasol, it is advantageous if the pivot angle of the arm is preferably limited by stops.

Functioning of the cantilever parasol is furthermore substantially improved by constructing the cantilever parasol such that the arm and the control rod are constructed to be hollow for the purpose of guiding a tensor member for opening and closing the parasol. In this case, the embodiment is particularly advantageous, in accordance with which a cable winder for the tensor member is provided at the free end of the control rod, by means of which the parasol can be opened and closed.

Locking of the control rod on the carrier element is performed, preferably by means of a clip, as a result of which the control rod is on the one hand locked quickly and simply and on the other hand the locking can be released again just as quickly and simply.

To prevent the arm from being extended unintentionally, the further development of the cantilever parasol is advantageous. Here, the arm may be latched in its extended position by means of a latch that can be released by hand again by means of a release member. The cantilever parasol having the extendable and retractable arm and the simple, combined operating elements does not only make it possible to operate the cantilever parasol simply and easily, but also, finally, makes it possible to fold it together in a manner suitable for transportation to give a compact, slender package, which is shortened such that in particular it may even be transported by car.

BRIEF DESCRIPTION OF THE DRAWINGS

Exemplary embodiments of the invention are described below in more detail and with reference to the drawings, in which.

DETAILED DESCRIPTION OF THE PREFERRED EMBODIMENTS

Figure 1:
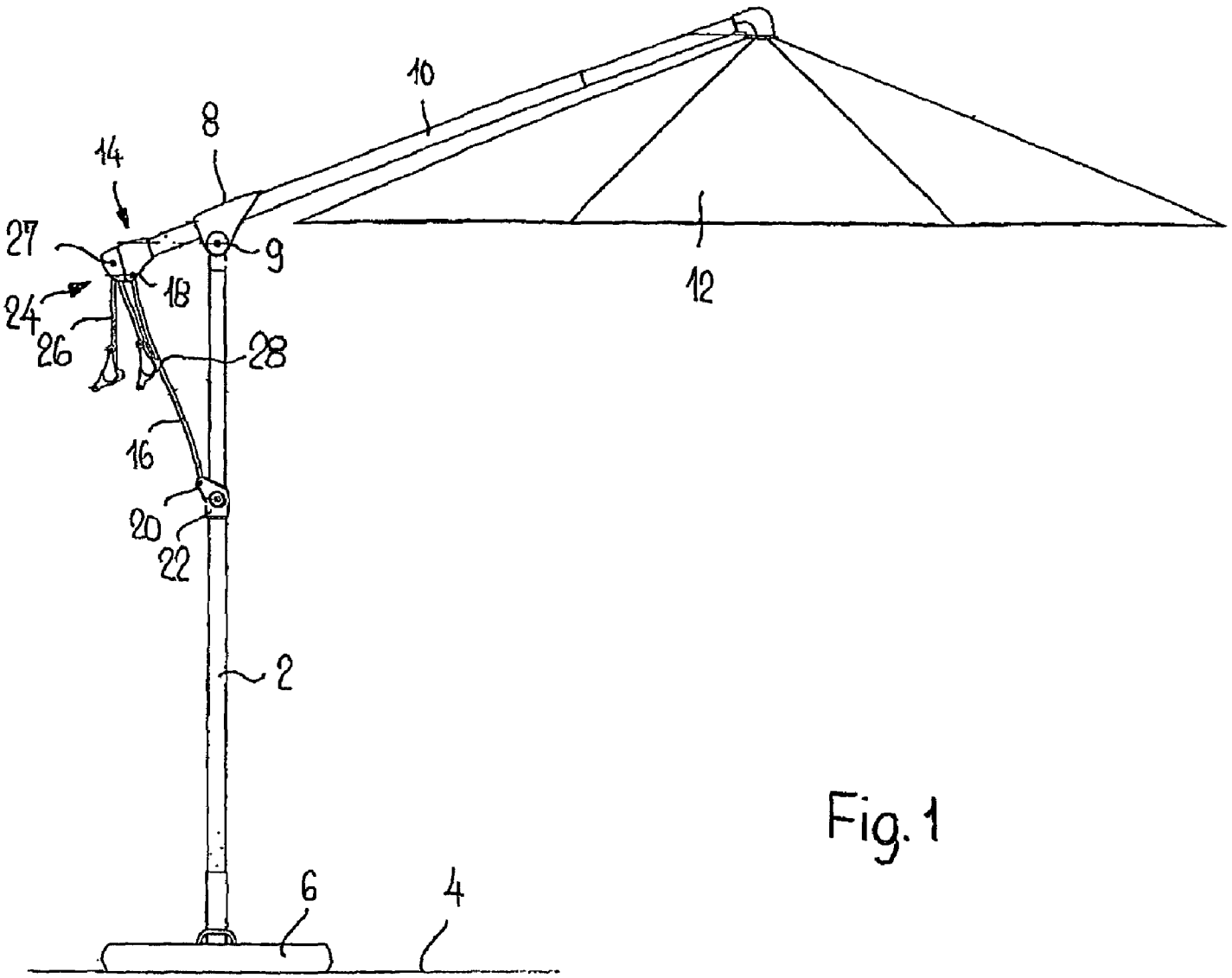
FIG. 1 shows a cantilever parasol in the spread condition, in side view.
Figure 2:
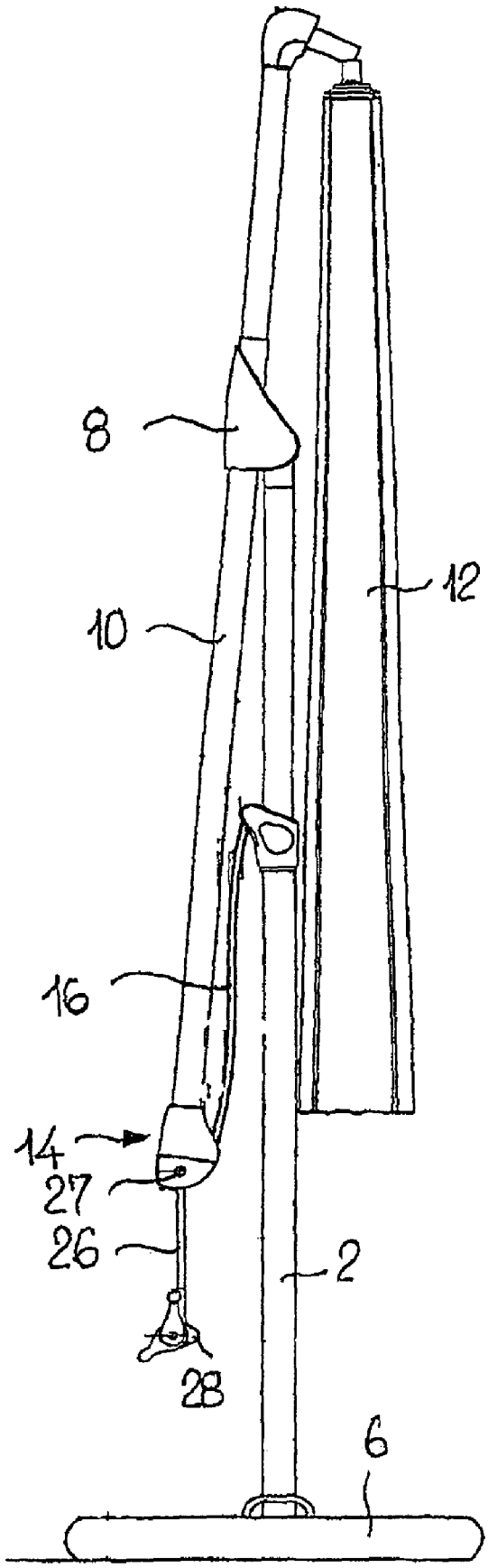
FIG. 2 shows the cantilever parasol from FIG. 1, in the folded-together condition.

FIG. 1 shows a cantilever parasol in its extended position, with the parasol open, and FIG. 2 shows this cantilever parasol in the closed, folded-up position. The cantilever parasol has a mast 2, which may be anchored in the ground 4 or in a base 6. At the upper end of the mast 2, on a sliding bearing 8, an arm 10 is mounted such that it may be extended and retracted in its longitudinal direction and such that it may pivot about its axis. The sliding bearing 8 is arranged on the mast 2 such that it may pivot by way of an articulation means 9. At one end the arm carries a parasol 12 and at the other end the arm 10 is mounted in a bearing 14 such that it may pivot about its axis. The bearing 14 is supported against the mast 2 by way of a carrier element 16. To this end, the carrier element 16 is secured to the bearing 14 by way of an articulation means 18 and to a carrier sleeve 22, which is arranged on the mast 2, by way of an articulation means 20. There is a locking device 24 on the bearing 14, for locking the pivot position of the arm 10 in a selectable pivot position. To this end, the locking device is fitted with a control rod 26 that is aligned such that it forms an extension to the arm 10 and that may be angled in relation to the carrier element 16 by way of an articulation means 27. The control rod may be latched to the carrier element 16 by means of a latching device 28. In the unlatched condition, the control rod 26 may be pivoted about the axis of the arm and may be detachably coupled to the arm by means of a coupling device 30 at selectable angles of rotation in relation to the arm, as will be apparent in detail from the embodiments and figures below. In this case, the control rod does hot project in a manner risking accidents, even when the parasol is positioned obliquely.

Figure 3:
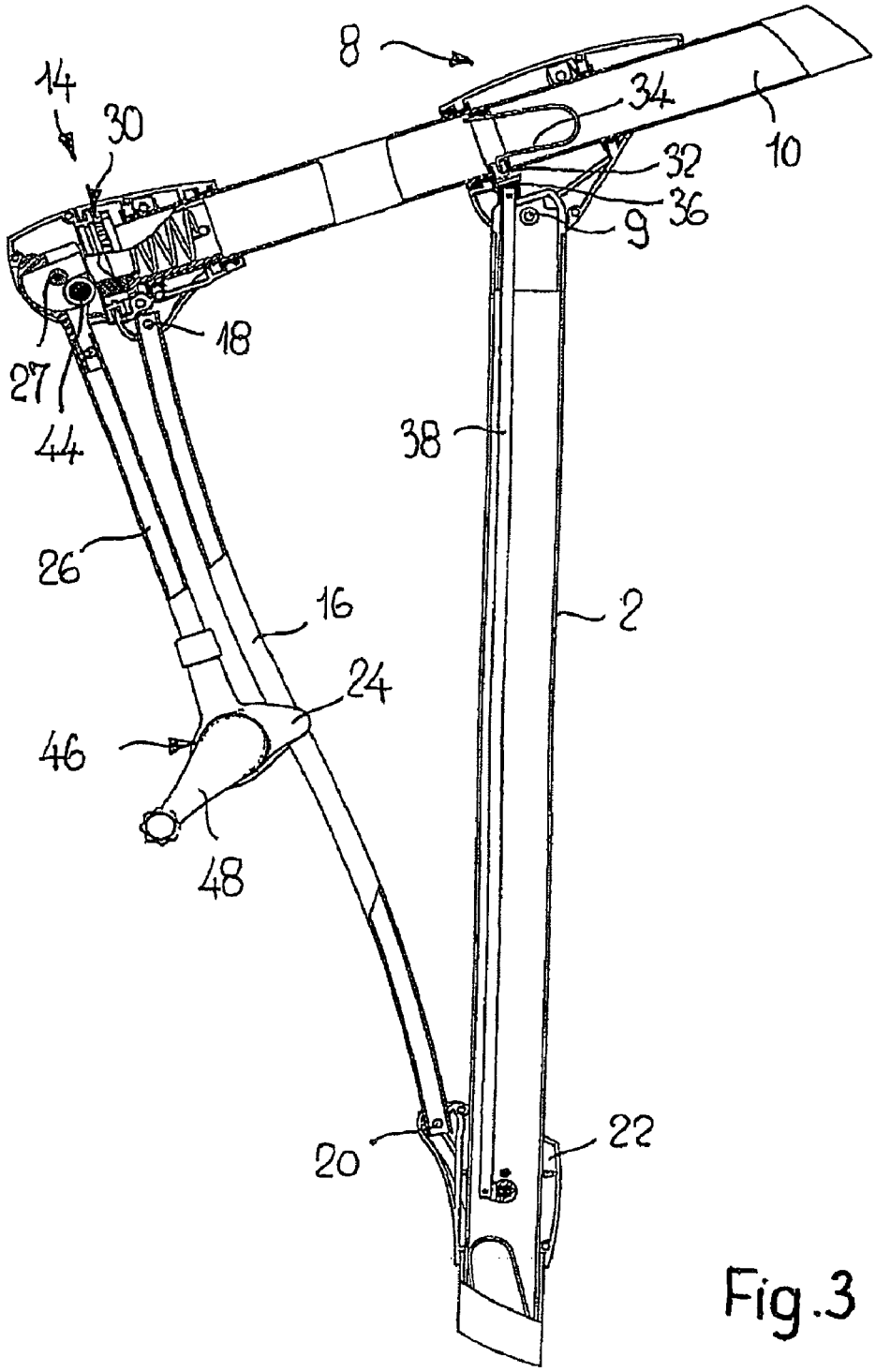
FIG. 3 shows the cantilever parasol from FIG. 1, in the locked condition, as a detail in vertical section and on a larger scale.

As can be seen from FIG. 3, the arm 10 is latched in the extended position by means of a latch 32 that is pretensioned outward by way of a spring 34. By means of a release member 36, which can be operated from an advantageous operating height by means of a push rod 38 and a handle (which is not illustrated in greater detail), the latch 32 may be pressed inward in opposition to the force of the spring 34, whereupon the arm 10 may be retracted in the axial direction, into the folded-up position that is shown in FIG. 2.

Figure 4:
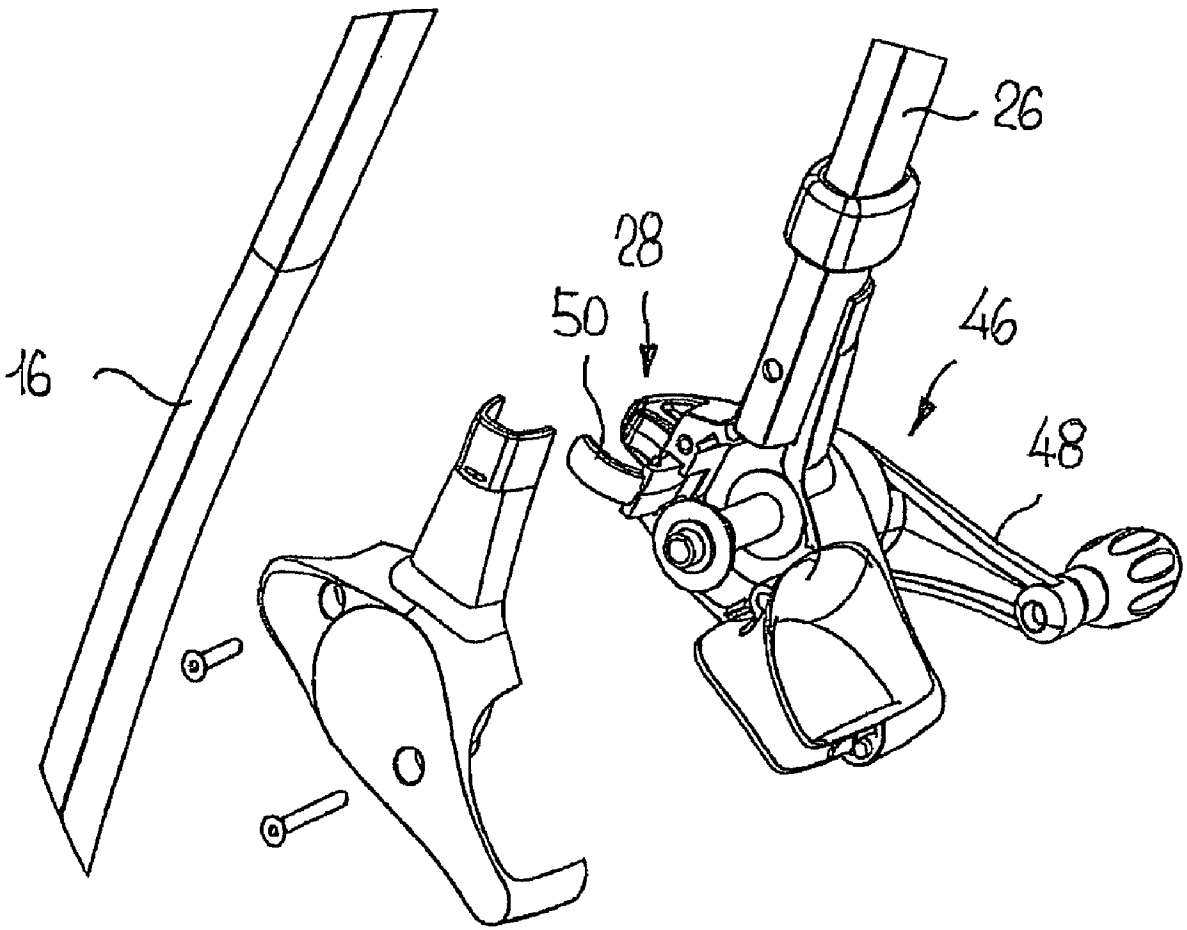
FIG. 4 shows the free end of the control rod, with a cable winder in diagrammatic and partly exploded view.

The arm 10 and the control rod 26 are hollow in form and are constructed to receive a tensor member 40, preferably a cable, which makes it possible to open and close the parasol in a manner that is not illustrated in greater detail but is known. A deflection member 44 is provided on the bearing 14, in the region of the articulation means 27 of the control rod 26, and this deflects the tensor member 40 out of the arm 10 and into the control rod 26 and guides it to a cable winder 46 that is arranged at the end of the control rod. The tensor member 40 may be wound up by means of a hand crank 48 in order to open the parasol 12, and unwound in order to close the parasol. A clip 50 of the locking device 24 is also arranged on the housing of the cable winder 46, as can be seen in particular from FIG. 4.

FIGS. 5 to 9 show the construction of the bearing 14 and the construction of the control rod 26 and the coupling device 30 and functioning thereof in detail, with extension and retraction of the arm, opening and closing of the parasol and oblique positioning thereof at a combined operating point at a preferred operating height outside the parasol being grouped together.

The bearing 14 is equipped with a housing 52 that is divided in its longitudinal direction and comprises the housing halves 52*a* and 52*b*. Bearing rings 54 56 are arranged on the arm 10 and are mounted in corresponding bearing rims 58 60 of the housing 52. At the end of the arm 10, a sleeve 62 is mounted slidably in the arm in the axial direction thereof. Grooves 64 on the outside of the sleeve 62, and springs 66 on the inside of the arm 10, ensure that the sleeve 62 is guided non-rotatably in the arm. A pin 70 that is arranged in bores 68 in the arm reaches through an elongate slot 72 in the sleeve 62 and limits the axial slide travel of the sleeve 62. A pressure spring 74 is supported against the pin 70 and serves to pretension the sleeve 62 in opposition to the control rod arrangement. The sleeve 62 carries a radially projecting cam 76, which cooperates with stops 78 in the housing 52 and limits the angle of pivoting of the arm 10 about its axis. Of the stops 78, only one is illustrated in the housing half 52*a*. A similar stop is also provided in the housing half 52*b*.

The sleeve 62 is part of the coupling device 30 and contains a first coupling part 80, which cooperates with a second coupling part 82 that is associated with the control rod 26. The coupling parts 80, 82 may be constructed to be form-fitting or force-fitting. In the present example, the coupling device is form-fitting, with coupling parts 80, 82 having toothed rings.

The second coupling part 82 is connected non-rotatably to the control rod 26. To this end, the second coupling part 82 is arranged in a housing part 84 that carries the control rod 26 and is mounted in the housing 52 such that it may pivot about the axis of the arm 10 by means of a bearing 85. The control rod 26 is furthermore pivotal about the articulation means 27 that is aligned transversely to the axis of the arm. The control rod 26 has a cam part 86, which brings about opening of the coupling device 30 and cooperates with a pressure piece 88 that is mounted on a flange 90 of the sleeve 62, which carries the first coupling part 80. The control rod 26 has support faces 92, 94 on either side of the cam part 86, and these cooperate with the pressure piece 88 and keep the control rod 26 releasably in the position in FIG. 7, where it is pivoted inward, or in FIG. 9, where it is pivoted outward, respectively.

Figure 5:
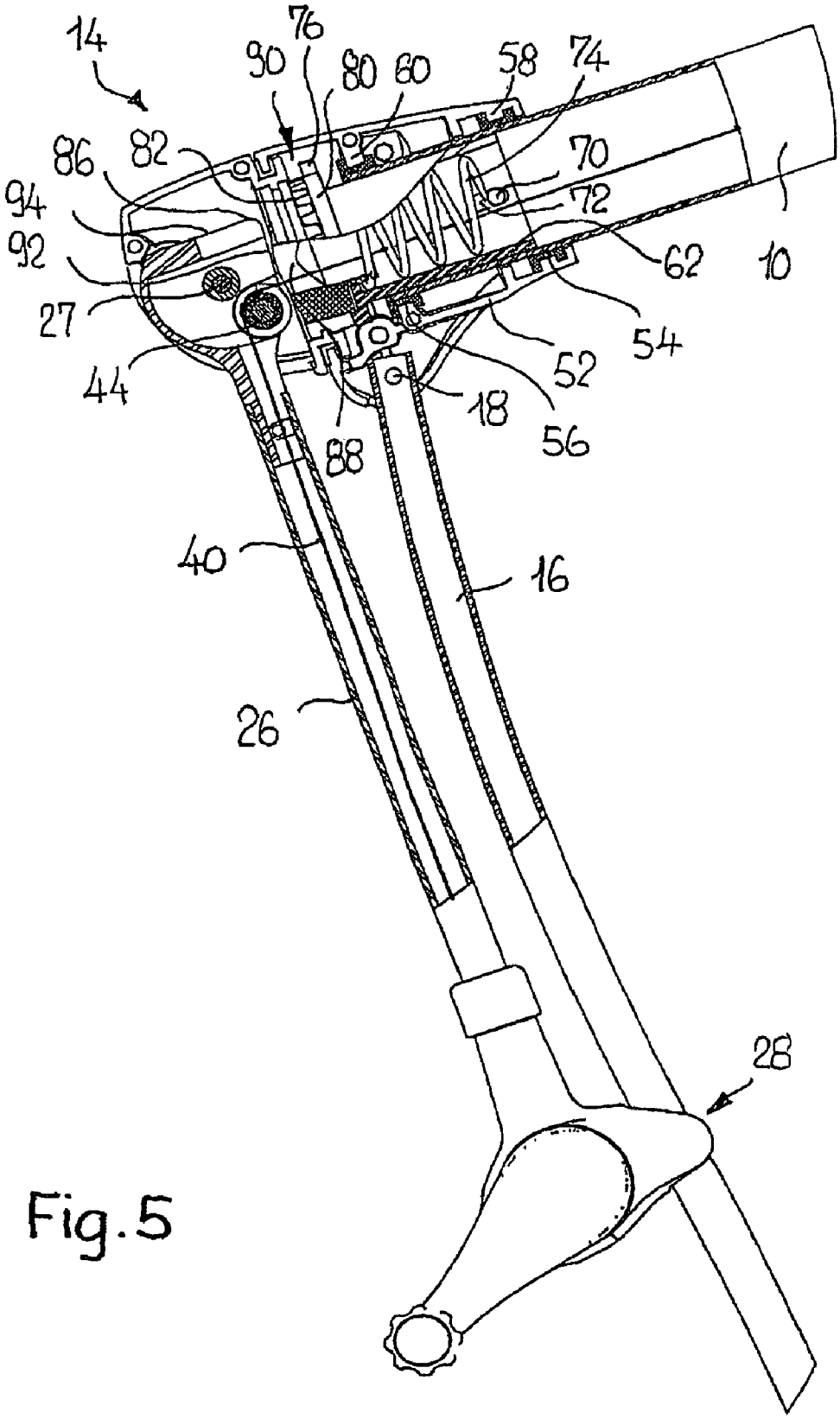
FIG. 5 shows the cantilever parasol from FIG. 3, in a detail on an even larger scale.
Figure 6:
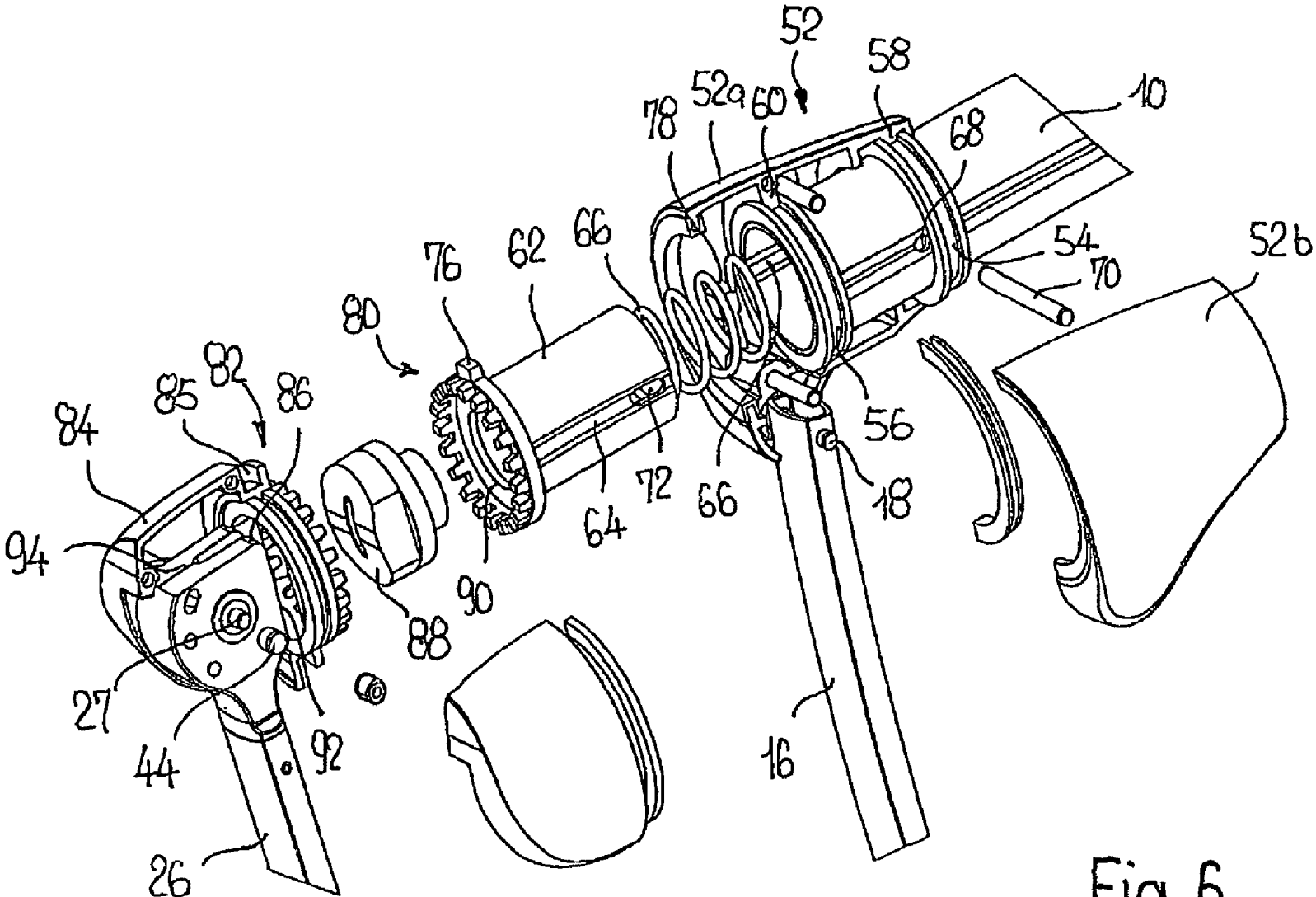
FIG. 6 shows the rear bearing of the arm according to FIG. 5, in a partly exploded view.

FIG. 5 shows the control rod 26 in the latched condition, in which the clip 50 of the latching device 28 is latched to the carrier element 16, with the result that it is not possible to pivot the control rod 26 either about the axis of the arm 10 or about the axis of the articulation means 27. In this condition, the first coupling part 80 and the second coupling part 82 are latched, with the result that it is no longer possible to pivot the arm about its axis or, consequently, to pivot the parasol.

Figure 7:
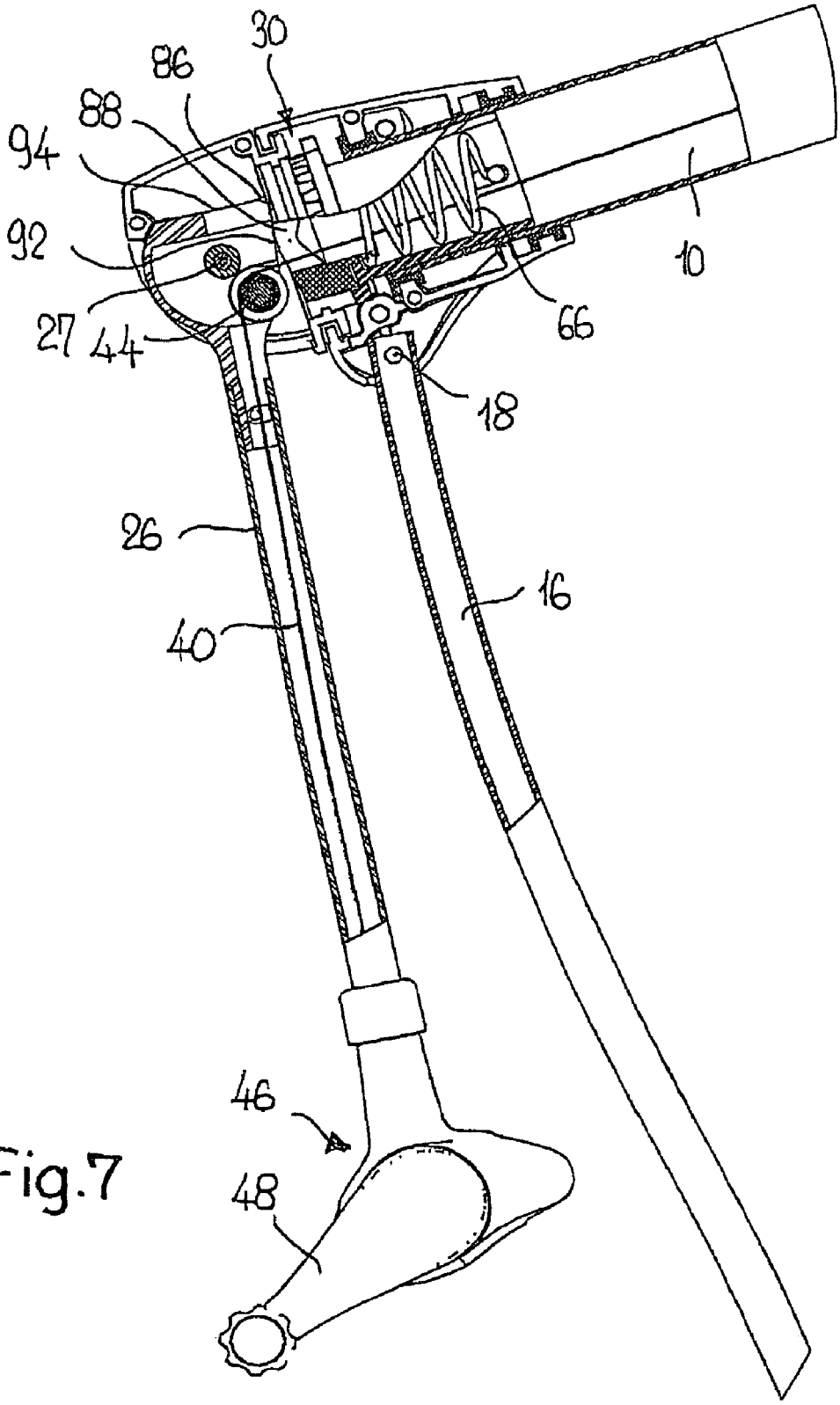
FIG. 7 shows the cantilever parasol from FIG. 3, with the control rod released.

FIG. 7 shows the control rod 26 in the unlatched condition, in which the control rod are pivotal about the axis of the arm. Because the coupling parts 80 82 are in engagement, the arm may at the same time be pivoted about its axis.

Figure 8:
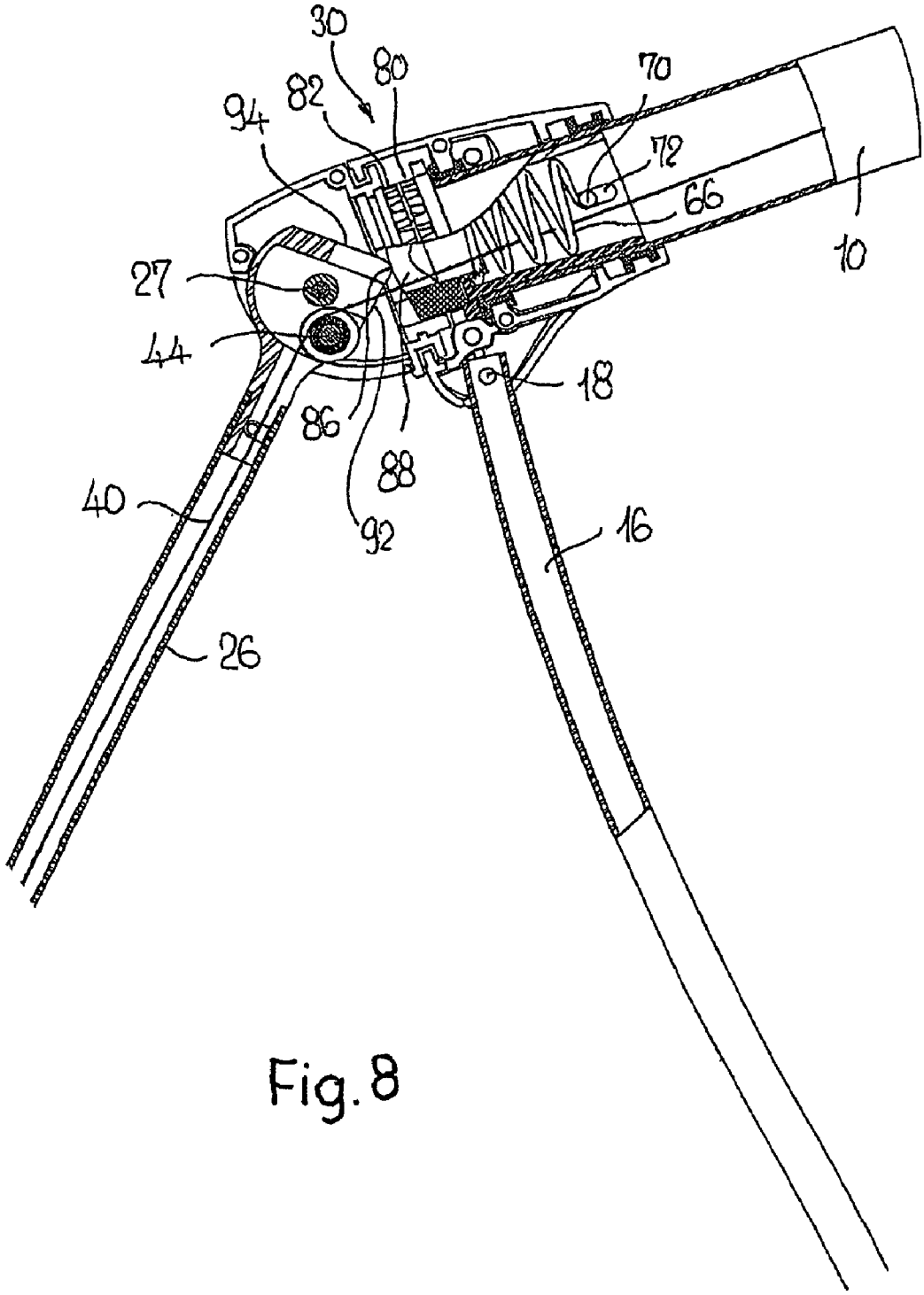
FIG. 8 shows the cantilever parasol from FIG. 3, with the coupling device released.

In order to lock the arm in a selected pivot position, the control rod 26 must first of all be pivoted outward into the uncoupling region, which is illustrated in FIG. 8, in that the cam part 86 slides the pressure piece 88 in opposition to the force of the spring 66 until the first coupling part 80 and the second coupling part 82 are disengaged, as shown in FIG. 8. In this uncoupled position, the control rod 26 can first of all be pivoted freely about the axis of the arm, at an angle that is intended to correspond to the pivot angle of the arm which is desired later on and hence to correspond to the desired oblique position of the parasol 12. Then, in this pivoted position, the control rod is pivoted back again toward the carrier element and so the coupling parts 80 and 82 are brought into engagement. It is then possible for the arm and hence the parasol to be brought into the pivot position which was previously desired, by pivoting the control rod 26 back parallel to the carrier element 16. By latching the control rod 26 to the carrier element 16 by means of the latching device 28, in a manner similar to the position in FIGS. 2 and 5, the pivotal position of the arm 10 and hence of the parasol 12 is then secured. The control rod 26, which is latched to the carrier element 16, consequently no longer projects dangerously transversely away from the arm. The arm 10 and hence the parasol 12 are pivoted back into the initial position, which is shown in FIG. 1, by performing the procedures in the reverse order.

Figure 9:
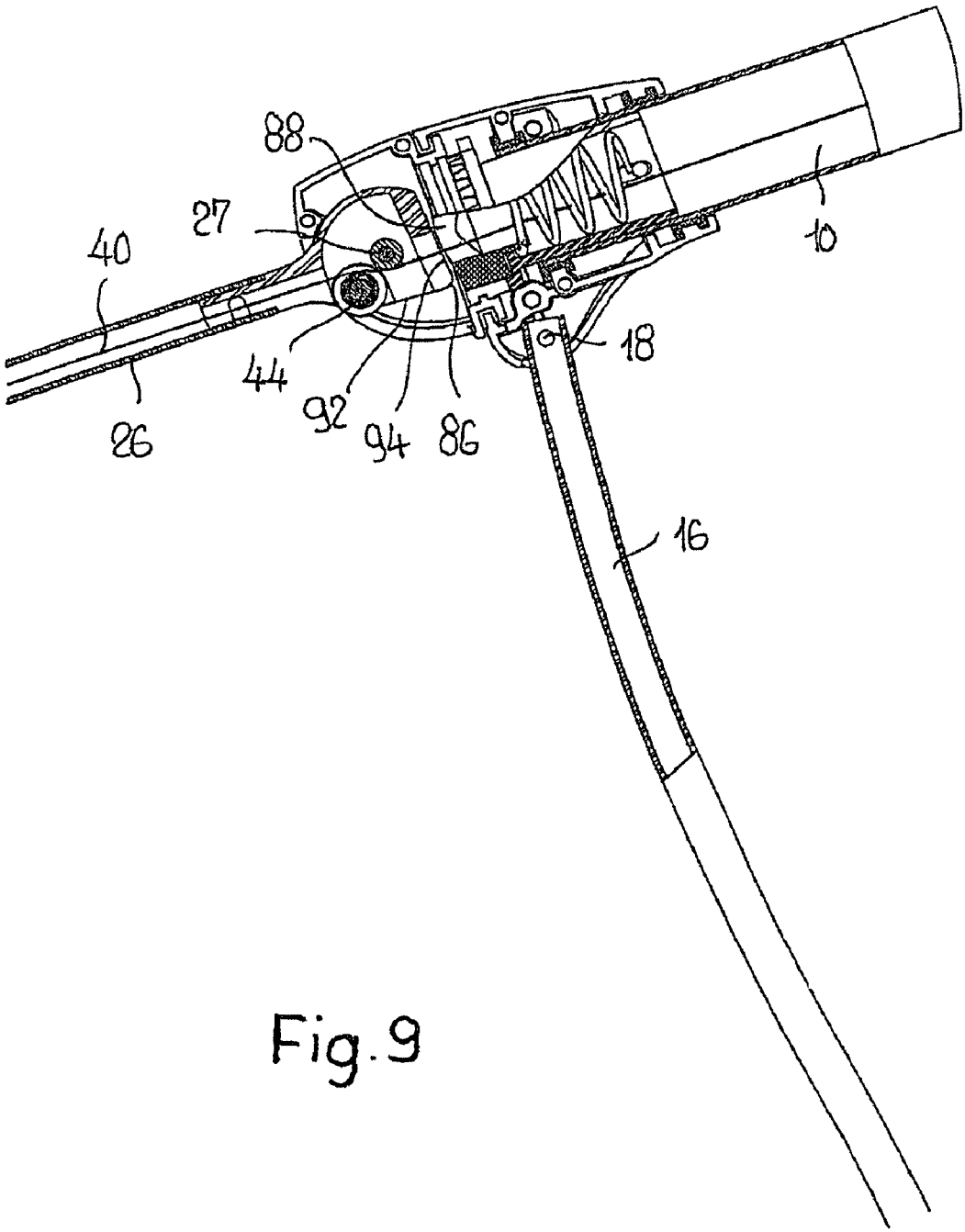
FIG. 9 shows the cantilever parasol from FIG. 3, with the control rod aligned in the longitudinal direction of the arm.

FIG. 9 shows the control rod 26 in a position in which it virtually forms an extension to the arm 10. The support face 96, which cooperates with the pressure piece 88, keeps the control rod 26 in the extended position. In this position, the coupling parts are in engagement. This position primarily serves for extending and retracting the arm in the axial direction and for folding the cantilever parasol together in such a way as to save space (FIGS. 2 and 11).

Figure 11:
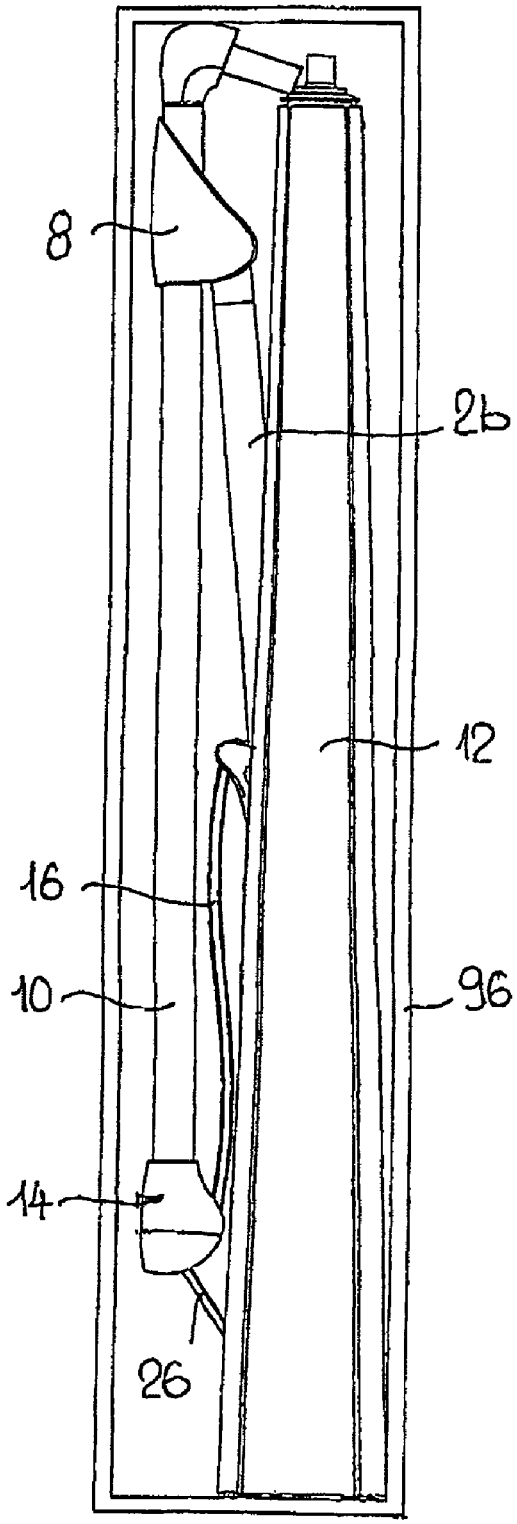
FIG. 11 shows the packed-up cantilever parasol from FIG. 10, with the parasol added.
Figure 10:
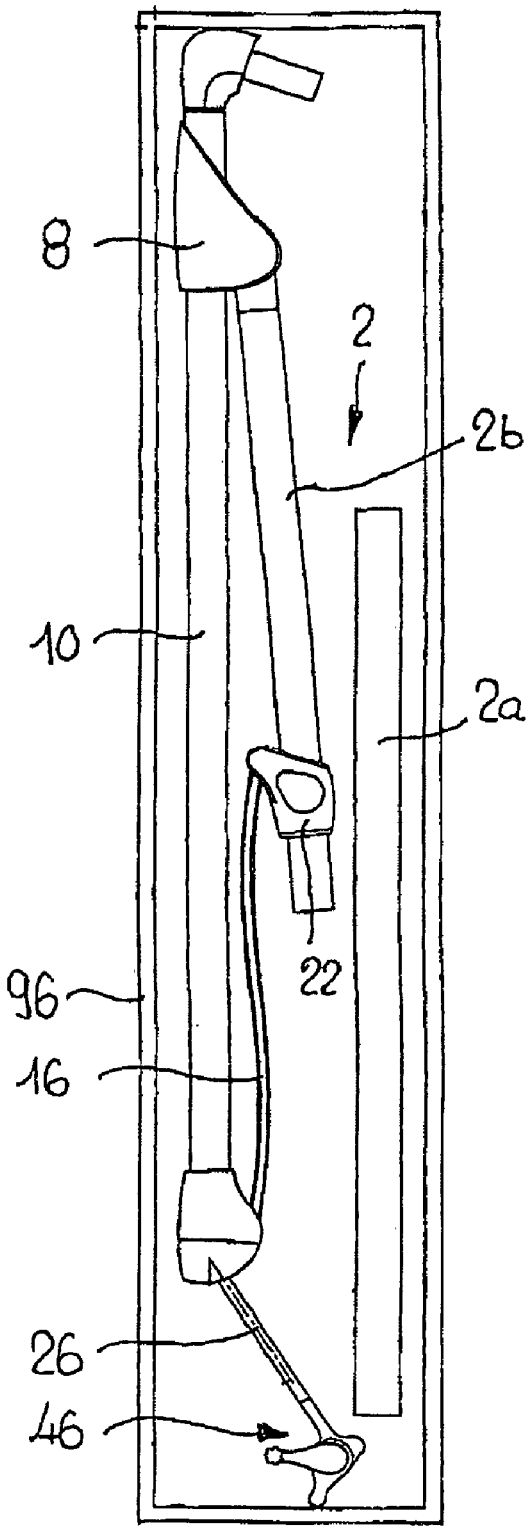
FIG. 10 shows the frame of the folded-together and partly dismantled cantilever parasol from FIG. 1, in a pack.

FIGS. 10 and 11 show the cantilever parasol in folded-together and partly dismantled form, in a packing container 96 that serves in particular for transportation and in some cases also for storage of the cantilever parasol. In this case, the parasol 12 is removed from the arm 10, and the mast 2 is broken into two parts 2*a* and 2*b* that may be pushed telescopically into one another. The arm 10, which may also comprise parts that may be pushed telescopically into one another, is laid with the broken mast 2 and the carrier element 16 and the control rod 26 in the lower part of the packing container 96, as shown in FIG. 10. The folded-together parasol 12 is laid in a second layer over this, as can be seen from FIG. 11. The parasol may where appropriate also be connected in articulated manner to the arm, with the result that the step of removing it is dispensed with and the parasol may be laid in the packing container together with the arm. Thus, even a relatively large cantilever parasol may be folded together compactly and transported in the minimum of space, with the result that the maximum dimensions for transportation by post and/or in a car—which are currently a length of 2 meters—may be observed. The possibility of packing compactly also minimizes the risk of damage during transportation.

The novel cantilever parasol has quite decisive advantages. The operating elements for extending and retracting the arm, opening and closing the parasol and positioning the latter obliquely are at a convenient operating height and outside the parasol, even in the case of large parasols. The means of extending, opening and positioning obliquely and locking in the oblique position are grouped together in a single operating unit, which is formed by the control rod together with the cable winder. Opening and closing the parasol and extending the arm may be performed at the same time or independently of one another.

The compact overall construction of the cantilever parasol on the one hand and the way in which the articulation means are fixed also give a high degree of stability and resistance to wind.

The sensitive drive parts of the cantilever parasol, in particular the coupling device and the active parts of the control rod, are accommodated in a housing that on the one hand protects them from the influence of soiling and weather and on the other also protects the person operating the parasol from the risk of injury. Moreover, the housing makes it possible for the cantilever parasol to have a rounded overall construction, which does not merely improve the appearance of the cantilever parasol but also reduces the risk of injury.

Pivoting the arm and hence positioning the parasol obliquely bring about only negligible alteration in the tension of the tensor member, for example the cable, when the parasol is open.

LIST OF REFERENCE NUMERALS

2 Mast
4 Ground
6 Base
8 Sliding bearing
9 Articulation means for 8
10 Arm
12 Parasol
14 Bearing
16 Carrier element
18 Articulation means for 14
20 Articulation means for 2
22 Carrier sleeve
24 Locking device
26 Control rod
27 Articulation means for 26
28 Latching device
30 Coupling device
32 Latch
34 Spring
36 Release member
38 Push rod
40 Tensor member
44 Deflection member
46 Cable winder
48 Hand crank
50 Clip for 28
52 Housing
52*a* Housing half
52*b* Housing half
54 Bearing rings
56 Bearing rings
58 Bearing rim
60 Bearing rim
62 Sleeve
64 Groove
66 Spring
68 Bore
70 Pin
72 Elongate slot
74 Pressure spring
76 Cam
78 Stop
80 First coupling part
82 Second coupling part
84 Housing part
85 Bearing of 84 in 52
86 Cam part
88 Pressure piece
90 Flange
92 Support face
94 Support face
96 Packing container

The invention claimed is:

1. A cantilever parasol, having a mast on which an arm is guided axially retractably and extendably and wherein the arm is pivotable about an axis of the arm, the arm carrying a parasol at one end and being mounted at the other end rotatably in a bearing, a carrier element articulated to the bearing and connected in an articulated manner to the mast, there furthermore being on the bearing a locking device for locking the pivot position of the arm, wherein the locking device has a control rod, the control rod extending from the arm, the control rod being pivotable relative to the carrier element about a second axis extending transverse to the axis of the arm, the control rod being latchable to the carrier element to thereby secure the control rod relative to the carrier element and wherein, in the unlatched condition, the control rod is pivotable about the axis of the arm and the second axis and wherein the control rod is detachably rotationally coupled to the arm relative to the axis of the arm by a coupling device wherein at selectable angles of rotation about the second axis the control rod is rotatable relative to the arm about the axis of the arm.

2. The cantilever parasol as claimed in claim 1, characterized in that the bearing is arranged in a housing on which the carrier element is articulated and wherein a housing part carries the control rod and is mounted such that the housing part can pivot about the axis of the arm, and wherein the coupling device is arranged in the housing part.

3. The cantilever parasol as claimed in claim 2, characterized in that the coupling device has a first coupling part which is arranged at the end of the arm and is non-rotatable and slidable in the direction of the axis of the arm, and wherein the first coupling part is pretensioned by a spring toward a second coupling part that is connected non-rotatably to the control rod, there being associated with the first coupling part a pressure piece associated with a cam part disposed on the control rod wherein the pressure piece is actuable to release the coupling device when the control rod is pivoted into an uncoupling region.

4. The cantilever parasol as claimed in claim 1, characterized in that the coupling device has a first coupling part which is arranged at the end of the arm and is non-rotatable and slidable in the direction of the axis of the arm, and wherein the first coupling part is pretensioned by a spring toward a second coupling part that is connected non-rotatably to the control rod, there being associated with the first coupling part a pressure piece associated with a cam part disposed on the control rod wherein the pressure piece is actuable to release the coupling device when the control rod is pivoted into an uncoupling region.

5. The cantilever parasol as claimed in claim 4, characterized in that the uncoupling region of the control rod lies between the position in which the control rod is locked on the carrier element and the extended position, which runs in the axial direction of the arm.

6. The cantilever parasol as claimed in claim 5, characterized in that the control rod has, on either side of the cam part, support faces that cooperate with the pressure piece, in order to fix the control rod in the positions on either side of the cam part temporarily.

7. The cantilever parasol as claimed in one of claim 6, characterized in that the coupling device is a form-fitting coupling device having a toothed coupling.

8. The cantilever parasol as claimed in claim 6, characterized in that the arm has stops that limit the pivot angle.

9. The cantilever parasol as claimed in claim 6, characterized in that the arm and the control rod are hollow and guide a tensor member for opening and closing the parasol.

10. The cantilever parasol as claimed in claim 6, characterized in that the control rod has a clip for locking the control rod to the carrier element.

11. The cantilever parasol as claimed in claim 6, characterized in that the arm can be latched in an extended position by a latch that is located in the arm and the arm can be released by a release member that is guided through the interior of the mast.

12. The cantilever parasol as claimed in claim 6, characterized in that the arm is telescopically collapsible whereby the arm can be folded together and shortened in a manner suitable for transportation to give a compact, slender package.

13. The cantilever parasol as claimed in claim 1, characterized in that the coupling device is a form-fitting coupling device having a toothed coupling.

14. The cantilever parasol as claimed in claim 1, characterized in that the arm has stops that limit the pivot angle.

15. The cantilever parasol as claimed in claim 1, characterized in that the arm and the control rod are hollow and guide a tensor member for opening and closing the parasol.

16. The cantilever parasol as claimed in claim 15, characterized in that a cable winder for the tensor member is arranged at the free end of the control rod.

17. The cantilever parasol as claimed in claim 1, characterized in that the control rod has a clip for locking the control rod to the carrier element.

18. The cantilever parasol as claimed in claim 1, characterized in that the arm can be latched in an extended position by a latch located in the arm and the arm can be released by a release member that is guided through the interior of the mast.

19. The cantilever parasol as claimed in claim 1, characterized in that the arm is telescopically collapsible whereby the arm can be folded together and shortened in a manner suitable for transportation to give a compact, slender package.

* * * * *

UNITED STATES PATENT AND TRADEMARK OFFICE

CERTIFICATE OF CORRECTION

PATENT NO. : 7,717,121 B2
APPLICATION NO. : 11/990481
DATED : May 18, 2010
INVENTOR(S) : Gustav Adolf Glatz It is certified that error appears in the above-identified patent and that said Letters Patent is hereby corrected as shown below:

Column 4, line 35, change "hot" to -- not --.

Signed and Sealed this

Thirteenth Day of July, 2010

David J. Kappos

David J. Kappos
*Director of the United States Patent and Trademark Office*